United States Patent [19]

Aldrich et al.

[11] 4,344,314

[45] Aug. 17, 1982

[54] ALIGNMENT APPARATUS

[75] Inventors: Roger B. Aldrich; Gary R. White, both of Grand Island, Nebr.

[73] Assignee: Chief Industries, Inc., Grand Island, Nebr.

[21] Appl. No.: 157,015

[22] Filed: Jun. 6, 1980

[51] Int. Cl.[3] ..... B21D 1/14

[52] U.S. Cl. ..... 72/461; 72/705

[58] Field of Search ..... 72/705, 457, 461

[56] References Cited

U.S. PATENT DOCUMENTS

| | | | |
|---|---|---|---|
| 3,091,278 | 5/1963 | Padgett | 72/705 X |
| 3,921,433 | 11/1975 | Whitney | 72/705 X |
| 4,055,061 | 10/1977 | Bayorgeon et al. | 72/705 X |
| 4,070,899 | 1/1978 | Vanalainen | 72/705 X |
| 4,138,877 | 2/1979 | Specktor | 72/705 X |
| 4,174,623 | 11/1979 | Le Grand et al. | 72/705 X |

FOREIGN PATENT DOCUMENTS

| | | | |
|---|---|---|---|
| 2718241 | 11/1978 | Fed. Rep. of Germany | 72/705 |
| 2745807 | 4/1979 | Fed. Rep. of Germany | 72/705 |
| 2246322 | 5/1975 | France | 72/705 |

*Primary Examiner*—Lowell A. Larson

*Attorney, Agent, or Firm*—Head & Johnson

[57] ABSTRACT

In combination with a treadway upon which a vehicle, whose structure is to be realigned, is positioned, an improved alignment apparatus interconnecting the treadway and a selected portion of the vehicle structure. The alignment apparatus has a base assembly having a horizontal leg with a vertical member attached thereto, and a clamping assembly secured to the vertical member for attachment to the vehicle structure. The horizontal leg is adapted to rest on the treadway and is interconnected to a plurality of spaced openings in the treadway. The alignment apparatus may be rigidly secured to the treadway, or may slide across the treadway in response to a pulling force applied either to the vehicle or the alignment apparatus all while supporting the vehicle structure.

26 Claims, 10 Drawing Figures

ALIGNMENT APPARATUS

BACKGROUND OF THE INVENTION

1. Field of the Invention

The present invention relates to an alignment apparatus and, more particularly, to such an apparatus which is capable of fully supporting a damaged vehicle and which is adapted to be attached to a selected portion of a damaged vehicle and either securely anchor, apply a pulling force, or is free to travel either latterally, fore-aft, and vertically while supporting the vehicle.

2. Description of the Prior Art

Numerous alignment mechanisms have been designed in the past so as to enable the repair and alignment of a damaged vehicle without large expenditures of time and man hours. One of the most popular such mechanisms is a device wherein the damaged vehicle is placed on a treadway and movable pulling powers apply forces through chains to selected portions of the damaged vehicle in order to realign the vehicle. The damaged vehicle is normally supported on the treadway by chains and/or blocks. More recently, various types of anchoring stands have been introduced and are used on occasion. The installation of these stands is time consuming; further, these anchoring stands have a very limited height adjustment such that these prior art devices are not able to change the balance of the load from the suspension of the damaged vehicle to the holding or anchoring device.

In the case of a unibody vehicle the rocker panels are the only effective portion of the damaged vehicle to which to apply a pulling force to realign the vehicle unless the vehicle is provided with shipping slots in the frame as on General Motors Corporation's "X-Body" cars. None of these prior art alignment mechanisms are capable of attachment to any selected portion of the damaged vehicle frame and at that point of attachment either apply a pulling force, securely hold or anchor that portion of the vehicle, or allow lateral, fore-aft and vertical travel of that portion of the damaged vehicle all while fully supporting the vehicle.

SUMMARY OF THE INVENTION

The present invention generally provides an alignment mechanism that is capable of fully supporting a damaged vehicle by the vehicle's suspension and frame. Further, the invention has the capabilities of being adjusted to a given height that will allow a balanced load between the suspension of the vehicle and the anchoring points. The higher the damaged vehicle is raised the more weight will be carried on the anchoring points and off of the suspension. Being able to change these balance of loads from suspension to anchoring points for various types of vehicles and various forms of damages is a very important part of correct and efficient collision repair.

Further, when used in conjunction with the Chief Industries' "E-Z LINER" alignment machine the present invention will allow alternate or additional blocking or jacking in areas near the frame intersection or rocker panels on a vehicle which has rocker panels not able to withstand the pulling forces. This capability allows for the efficient realignment of a damaged vehicle without damaging the rocker panels of this type of vehicle.

Further, the present invention is capable of being installed in any position on a damaged vehicle and is capable of being installed in any position on the treadway or frame machine. The device is designed to work efficiently on all types of vehicles and on all types of damages regardless of where the damage is or how extensive it is. The present invention is lightweight, small in size, and designed to allow for the capability of adjustment either laterally, vertically, or fore-aft.

DETAILED DESCRIPTION OF THE PREFERRED EMBODIMENTS

Figure 1:
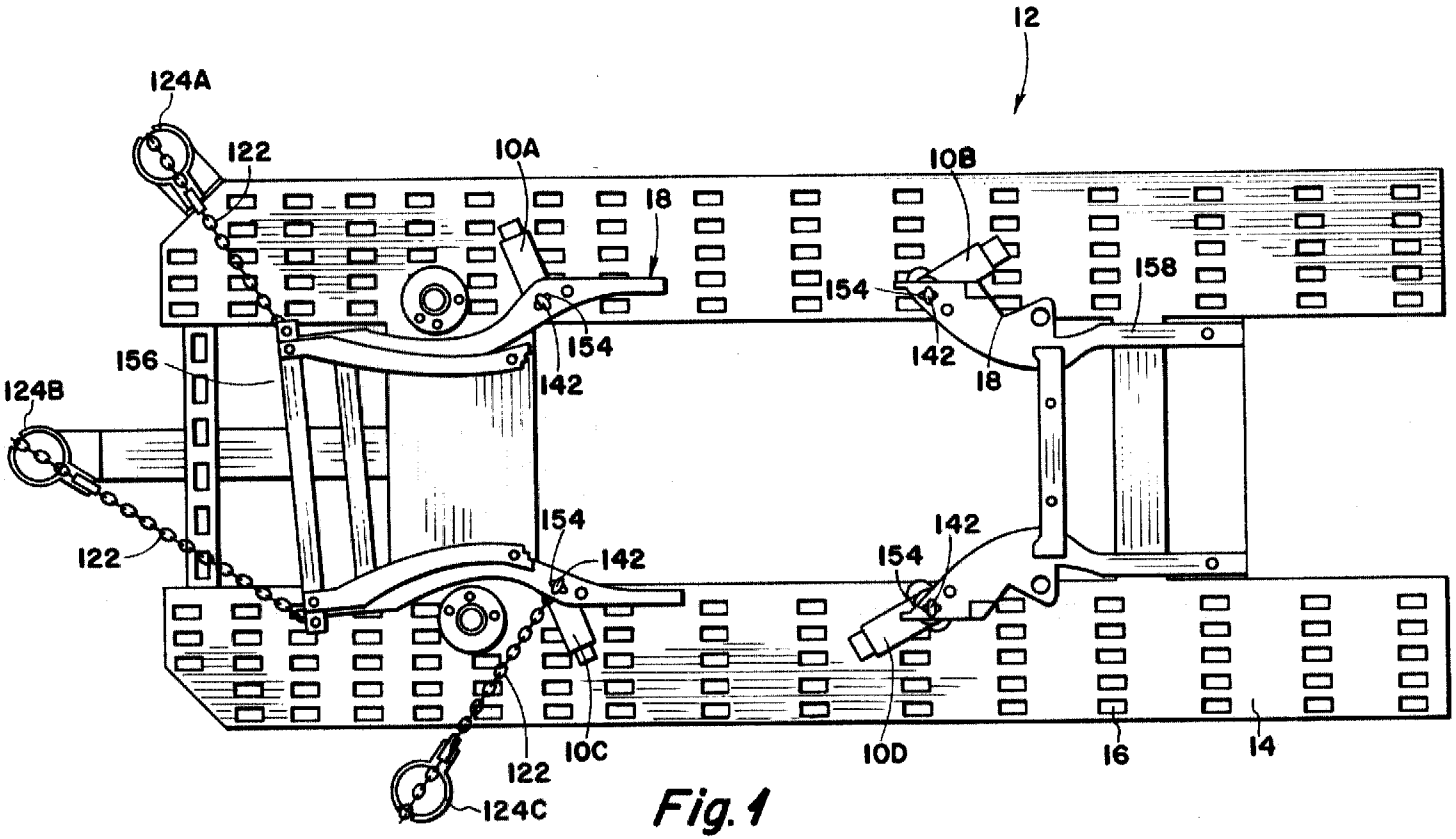
FIG. 1 is a top plan view of a damaged vehicle, represented by the frame members of a unitized body vehicle secured to an alignment machine with attachment devices embodying.

Referring to the drawings in detail, reference character 10 generally indicates an attachment mechanism for use with an alignment machine, such as a Chief Industry "E-Z-Liner," covered by U.S. Pat. No. 3,888,100. The alignment machine designated by numeral 12 in FIG. 1, and includes a treadway 14, with a plurality of aligned openings 16 spaced therein, upon which a damaged vehicle, represented in FIG. 1 by a damaged vehicle frame 18, is supported by the attachment mechanisms 10. The present invention allows the vehicle to be supported by the vehicle suspension or frame without the need to fully support the vehicle on anchoring stands (not shown).

Figure 3:
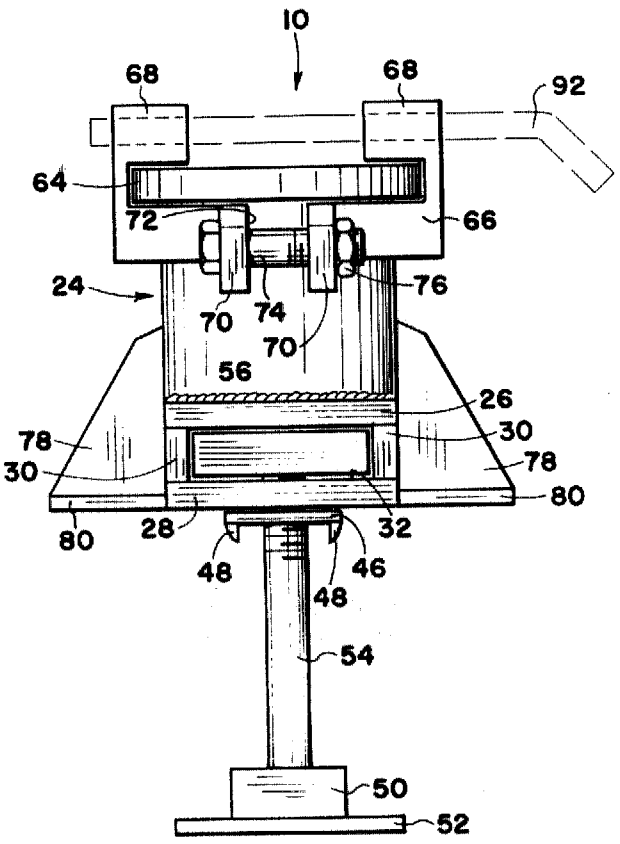
FIG. 3 is an elevational view of one end of the present invention.
Figure 2:
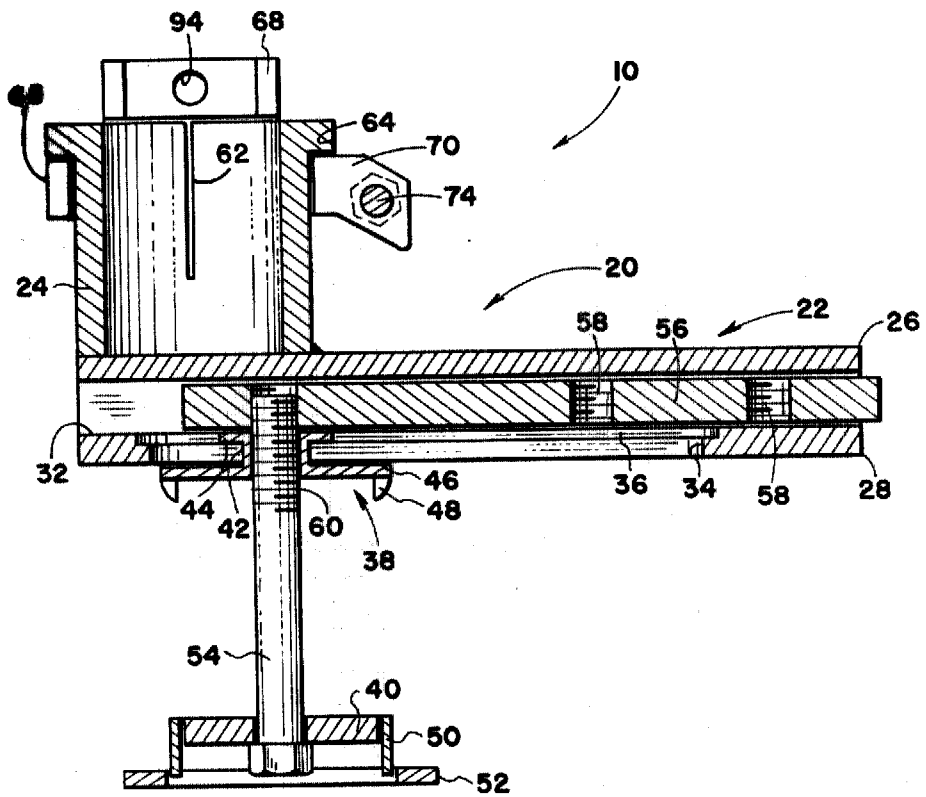
FIG. 2 is a side sectional view of the present invention.

As shown in FIGS. 2 and 3, each attachment mechanism 10 is comprised of a base assembly 20, which is provided with a horizontal leg member 22 and a vertical member 24. The vehicle member 24 is either formed a part of the leg member 22 or is connected thereto as by welding. The leg member 22 has a horizontal upper portion 26 and a lower portion 28 spaced apart by parallel side members 30 to define an opening or space 32 therethrough. The lower portion 28 is planar and is adapted to rest or slide upon the treadway 14 of the alignment machine 12.

The lower portion 28 is provided with an elongated horizontal opening 34 extending axially therethrough. The opening 34 has an upper portion 36, which opens into the space 32 and is of a length and width greater than the opening 34. Means are provided to interconnect the base assembly 20 to the treadway 14 and includes a first connector 38 adapated to connect with the topside of the treadway 14 through one of the openings 16 and a second connector 40 to connect to the underside of the treadway 14 through the same opening 16. The first connector 38 has a cylindrical vertical extension 42, extending into the opening 34, and a top annular flange 44 thereon engageable within the upper portion 36 of the opening 34. The first connector 38 is adapted to slide or rotate within the opening 34. A bottom portion 46 of the first connector 38 is provided with a plurality of teeth 48 to facilitate engagement with one of the openings 16 in the treadway 14. The second connector 40 has a rectangular portion 50, which is received into one of the openings 16 in the treadway 14, and a lower flange 52 which engages the treadway 14. An elongated bolt 54 extends through the first and second connectors 38 and 40 and extends into the opening 34. A hold down bar 56, which has a plurality of spaced threaded holes 58 therein, is disposed within the space 32 and is adapted to slide axially therein. A threaded portion 60 of the bolt 54 is received into one of the threaded holes 58 in the hold down bar 56. As can be seen, this arrangement allows the base assembly 20 to either be immovably secured to the treadway 14 by tightening the bolt 54 or the bolt 54 may be loosened so that the base assembly 20 is able to rotate around the vertical axis of the bolt 54 or may slide fore and aft as determined by the first connector member 38 sliding within the opening 34. The different holes 58 are provided so that the base assembly 20 will have greater extent of movement when the bolt 54 is threaded into one of the holes 58. As shown in FIG. 2, the vertical member 24 is preferably of a hollow cylindrical configuration and is provided with at least one elongated vertical cut 62. An annular flange 64 is attached to the top of the vertical member 24 and, as best shown in FIG. 3, a clamping means 66 is secured to the vertical member 24. The clamping means 66 is adapted to rotate around the annular flange 64 and is provided with oppositely spaced ears 68, which ride upon the flange 64. The clamping means 66 has two parallel lugs 70 which extend outward from either side of a cut 72 in the clamping means 66. A bolt 74 extends through the lugs 70 and is provided with a nut 76 threaded onto the end thereof. When the bolt 74 and the nut 76 are tightened the clamping means 66 is drawn together around the vertical member 24 to compress the cut 62. This purpose will be described in more detail hereinbelow. The base assembly 20 is provided with vertical buttress-type supports 78 which extend from the vertical support 24 to a pair of horizontal plates 80, which extend outwards from either side of the lower portion 28 of the horizontal leg member 22.

Figure 4:
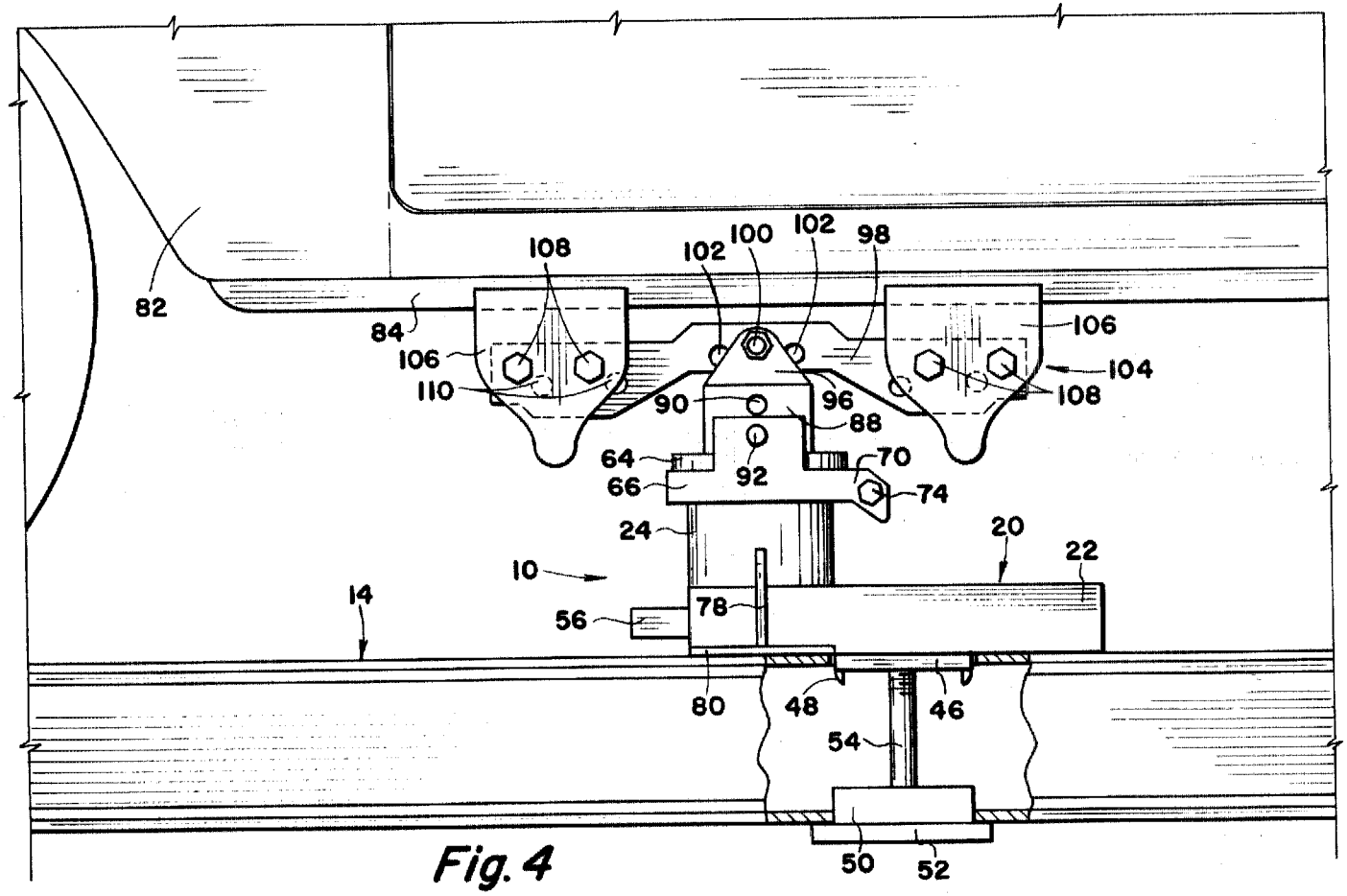
FIG. 4 is a side elevational view of the present invention connected of a vehicle.

When a damaged vehicle is to be realigned and is placed upon the treadway 14, an attachment means is needed to connect the base assembly 20 to the vehicle. The present invention provides a novel means to support a portion of the damaged vehicle and at the same time either securely maintain that portion of the vehicle from movement or to allow movement of that portion of the vehicle when it is being realigned. The present invention is further adapted to be used with different types of construction, such as unibody or conventional frame construction. As shown in FIG. 4, a vehicle 82 having a unibody type construction and type rocker panels 84 is supported upon the treadway 14 by means of the attachment mechanism 10.

In order to connect the attachment mechanism 10 to the rocker panels 84 a unibody attachment means 96 is connected to the base assembly 20. The attachment means 96 is comprised of a tubular lower member 88, which is received into the vertical member 24 and may rotate therein. The bolt 74 and nut 76 is then tightened to secure the vertical member 24 within the member 88. The member 88 is provided with a plurality of vertically aligned holes 90 spaced therethrough. A rod 92, as best shown in FIG. 3, extends through a hole 94 in one of the ears 68 and through the holes 90 and through another hole 94 in the opposite ear 68. This arrangement of holes in the rod 92 allows for the rotation and vertical adjustment of the member 88 within the vertical member 24 to aid in installation of the attachment mechanism 10 and in the realignment process.

A pair of vertical parallel members 96 extend upwards from the upper portion of the tubular lower member 88 with a horizontal bar 98 secured therebetween by means of a threaded bolt and nut means 100 which passes through one of a plurality of spaced holes 102. A jaw means 104 is provided on either end of the bar 98 and is comprised of two opposed grasping members 106 which are adapted to be drawn together by means of a plurality of bolts 108 which pass through holes 110, into engagement with the rocker panel 84. The rocker panel 84 may be of a pinch weld type construction or any other construction which the jaw means 104 can be clamped to. The grasping members 106 are pivotally secured at the lower portion of each by means of a pin 112. A spring 114 is provided around the bolts 108 and between the grasping members 106 and bar 98 to bias the jaw means 104 apart.

Figure 5:
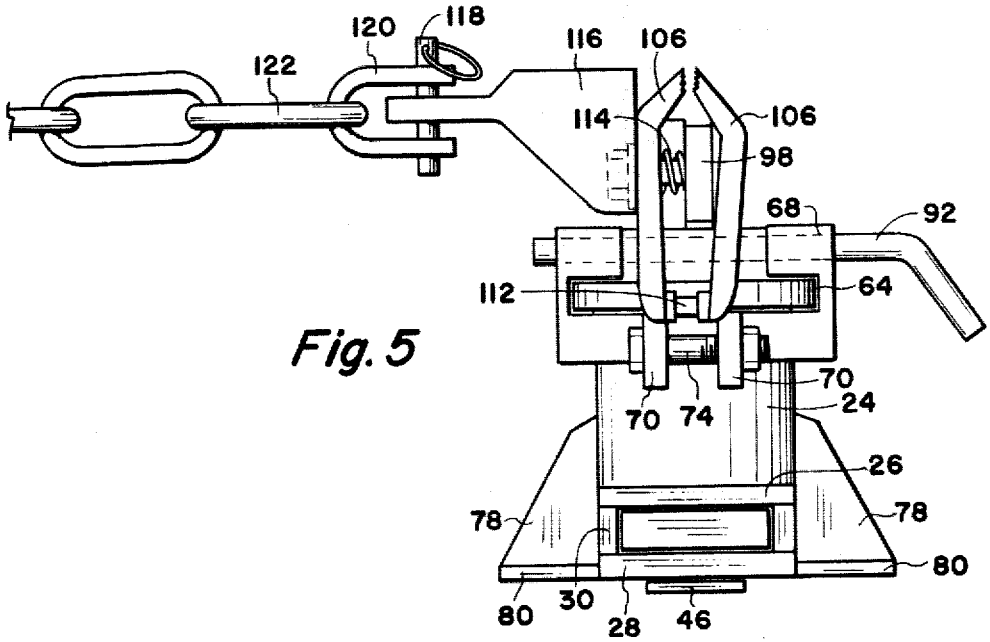
FIG. 5 is an elevational view of one end of the present invention with a pulling bracket and chain attached thereto.
Figure 6:
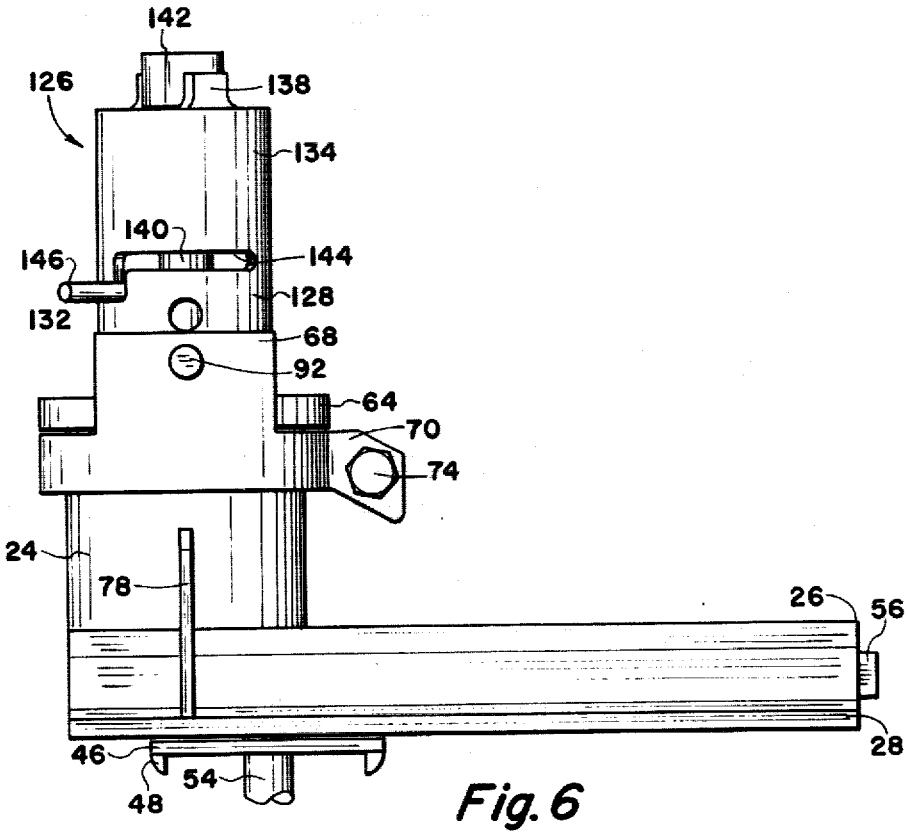
FIG. 6 is a side elevational view of the present invention with an alternate embodiment of attachment means connected thereto.

As shown in FIG. 5, a pulling bracket 116 is secured to the lower member 88 by means of the bolt 100 and is connected through a pull pin 118 and shackle 120 to a chain 122, which is in turn connected to the pulling powers 124 A, B and C, shown in FIG. 1, of the alignment machine 12.

As noted above, the total alignment procedure utilizing the present invention will be described in more detail in the operational description hereinbelow.

Figure 8:
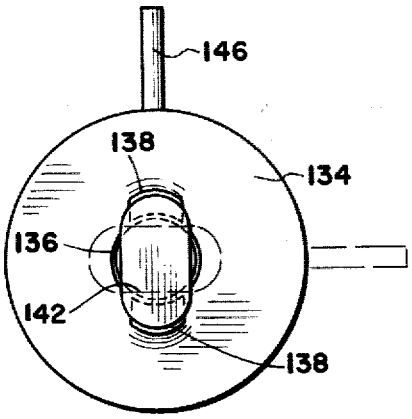
FIG. 8 is a top plan view of the alternate attachment means.
Figure 10:
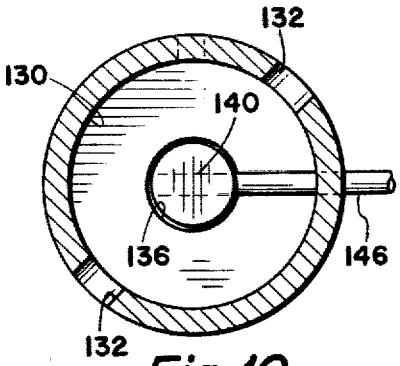
FIG. 10 is a view taken along line 10—10 of FIG. 9.
Figure 7:
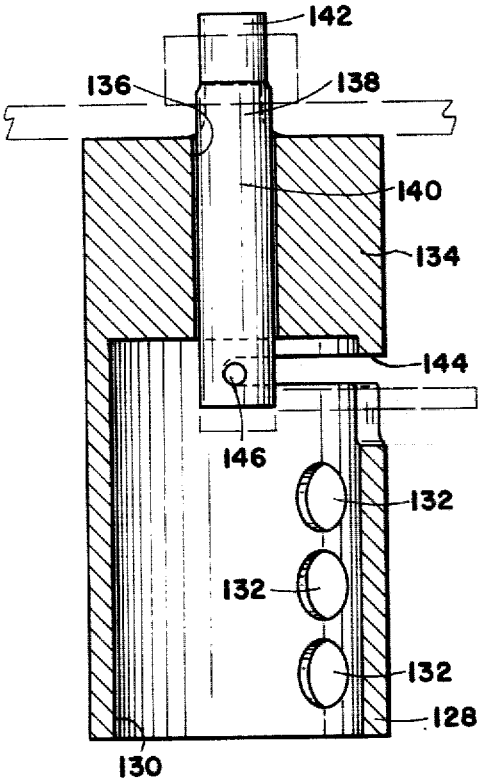
FIG. 7 is a side elevational view of the alternate attachment means.
Figure 9:
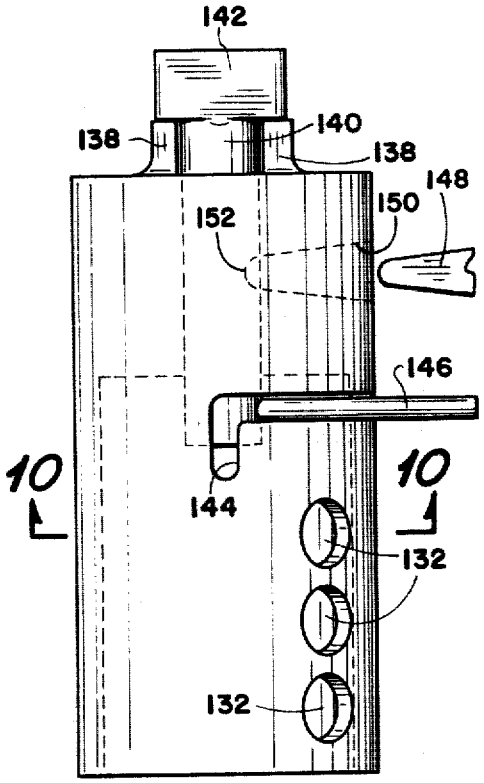
FIG. 9 is a side elevational view of the alternate attachment means.

Certain types of vehicle structures or frames are provided with slots for use in handling of the vehicle during manufacturing and also as transportation hold down points. These slots may be utilized as points to connect the attachment mechanisms 10. In order to take advantage of these slots for alignment purposes an alternate attachment means 126 has been designed for cooperation with the base assembly 20. The attachment means 126 has a tubular casing 128 in configuration and is adapted to be received within the vertical member 24. As shown in FIGS. 7 and 10, the attachment means 126 has a central cavity 130 extending partially into the casing 128. The lower portion of the casing 128 is provided with a plurality of aligned holes 132 which extend therethrough for cooperation with the rod 92 to allow vertical adjustment of the attachment means 126. The casing 128 is provided with a solid upper portion 134 which has an axial bore 136 extending centrally therethrough. The top surface of the upper portion 134 is provided with a pair of oppositely spaced, semi-rounded upsets 138, as shown in FIGS. 8 and 9, on either side of the bore 136. A rod 140, with an oblong finger portion 142 on the top end thereof, extends through the bore 136 and into the opening 130. A stepped slot 144 is provided in the lower portion of the casing 128 adjacent the upper portion 134. A handle 146 extends from the lower portion of the rod 140 outwards through the stepped slot 144.

When the attachment means 126 is to be connected to one of the slots in the vehicle structure the handle 146 is rotated to bring the finger portion 142 into alignment with and resting upon the upsets 138. The upsets 138 and the finger portions 142 are received into these slots within the vehicle structure. The handle 146 is then rotated 90° to rotate the finger 142 to securely fasten the vehicle structure to the attachment means 126 as shown by dashed lines in FIG. 7. A wedge 148 is received into a slot 150 in the upper portion 134 and is cooperable with an indentation 152 in the rod 140 to prevent the rotation thereof. As can be seen, the attachment means 126 provides a fast and simple attachment means to a vehicle provided with the necessary slots.

To best understand the operation of the attachment mechanism 10 FIG. 1 is provided which shows a damaged vehicle frame 18 disposed upon the treadway 14 of the alignment machine 12. In this representation, the vehicle frame 18 is of the type which is provided with frame slots 154 as described above which the attachment means 126 is adapted to cooperate with. For example, a front portion 156 of the vehicle is out of alignment with the undamaged rear portion 158 due to a collision. In order to bring the front portion 156 into correct alignment, the pulling towers 124A, B and C are moved into correct position to apply pulling forces so that the chains 122 may be connected therefrom to the appropriate locations on the vehicle. The vehicle is supported and connected to the treadway 14 by means of the attachment mechanisms 10A, B, C and D. Since the rear portion 158 of the vehicle is undamaged it does not need to be aligned in any manner and should be prevented from moving when the pulling forces are applied to the front portion 156. The attachment mechanisms 10B and D are securely fastened to the treadway 14 by means of tightening the bolt 54 to prevent the movement of the base assemblies 20. If the vertical alignment of the rear portion 158 is correct then the rod 92 will be inserted to prevent any vertical or rotary movement.

The point at which the attachment mechanism A is secured does not require a pulling force at that point but will be required to rotate and/or slide on the treadway 14 when the front portion 156 of the vehicle is pulled into proper alignment. This movement of the attachment mechanism 10A is enabled by the first connector 38 and second connector 40 being secured to the treadway 14 to the extent that the base assembly 20 is able to not only rotate around the vertical axis of the bolt 54, but also linearly slide relative to the hold down bar 56.

The point at which the attachment mechanism 10C is connected is to be drawn towards the pulling tower 124C and as such is connected to the chain 122 by means of the pulling bracket 116, which may be connected to the attachment means 126 by any conventional means.

When the pulling forces are applied, the front portion 156 is brought back into proper alignment while the attachment mechanisms 10A and C move in response to this realignment while the attachment mechanisms 10B and D prevent any movement of the rear portion 158. The above described arrangement would be the same for a vehicle having a unibody construction wherein the jaw means 104 would be connected to the rocker panels 84 and the same pulling forces would be applied. When used in conjunction with a Chief Industries' "E-Z LINER" alignment machine, if the rocker panels 84 are not able to withstand the pulling forces, the present invention can be used to give additional blocking or jacking support to the vehicle so that the rocker panels 84 would not have to sustain the full pulling forces.

If the frame 18 has become twisted then the rod 92 is removed from the clamping means 66 to allow for the vertical adjustment of the frame 18 when it is brought into proper alignment. This vertical adjustment capability allows a balanced load between the frame 18 and the anchoring or points of attachment. The higher the vehicle is raised the more weight will will be carried by the attachment mechanism 10 and off of the frame 18. Being able to change this balance of load from the frame 18 to the attachment mechanism 10 for various types of vehicles and extents of damage is very important for correct and efficient collision repair. The differently spaced holes 102 and 110 are provided so that the leverage applied through the chains 122 may be adjusted for correct realignment as well as for allowing the attachment means 86 to be adjustable to different configurations or rocker panels 84.

The present invention provides a novel means on which a damaged vehicle may be supported at different selected portions of the vehicle structure and at the same time will either secure that portion of the vehicle to the treadway 14 to prevent any movement when pulling forces are applied or that will allow that portion to be free to rotate, move laterally fore and aft, or move vertically when a pulling force is applied to a different portion of the vehicle or applied directly to the vehicle through the attachment mechanism 10. The present invention is simple to operate, easily hauled by one person and can be used on any type of vehicle to provide fast and efficient realignment and collision repair.

Whereas the present invention has been described in particular relation to the drawings attached hereto, it should be understood that other and further modifications of the invention, apart from those shown or suggested herein, may be made within the scope and spirit of this invention.

What is claimed is:

1. In a treadway upon which a vehicle, whose structure is to be realigned, is positioned, said treadway including a plurality of spaced openings arranged in a predetermined array, the improvement in means to interconnect the treadway and a selected portion of the vehicle structure comprising:

a base assembly having an elongated horizontal leg and a vertical member, said horizontal leg including an upper and lower portions spaced to define a horizontal opening therebetween, said lower portion of said elongated horizontal leg adapted to rest on the treadway;

a hold down bar receivable within said horizontal opening;

means positionable within the spaced openings of the treadway to interconnect said hold down bar to the treadway; and attachment means secured to said vertical member for attachment to the selected portion of the vehicle structure;

whereby said means to interconnect may be securely fastened to said treadway to prevent movement relative thereto of said base assembly and said hold down bar or fastened to said treadway to prevent movement relative thereto of said base assembly and said hold down bar or fastened to said treadway to allow movement of said base assembly with that selected portion of the vehicle structure being realigned.

2. Improved means to interconnect as in claim 1 wherein said vehicle having a unibody type construction.

3. Improved means to interconnect as in claim 1 wherein said lower portion of said horizontal leg having vertical support means connected to said vertical member.

4. Improved means to interconnect as in claim 1 wherein said horizontal opening extends axially through said horizontal leg.

5. Improved means to interconnect as in claim 1 wherein said vertical member is adjacent one end of said horizontal leg.

6. Improved means to interconnect as in claim 1 wherein said means to interconnect said hold down bar to the treadway is comprised of connector means engageable with the treadway, and means to connect said connector means to said hold down bar.

7. Improved means to interconnect as in claim 6 wherein said lower portion of said horizontal leg is provided with a horizontal elongated opening therethrough.

8. Improved means to interconnect as in claim 7 wherein said horizontal elongated opening extends axially through said lower portion.

9. Improved means to interconnect as in claim 7 wherein said means to connect said connector means to said hold down bar extends through said horizontal elongated opening in said lower portion of the elongated horizontal leg.

10. Improved means to interconnect as in claim 9 wherein said means to connect said connector means to said hold down bar is an elongated bolt receivable into one of a plurality of threaded holes spaced in said hold down bar.

11. Improved means to interconnect as in claim 6 wherein said connector means is comprised of a first connector member engageable with the underside of the treadway and a second connector member engageable with the top side of the treadway and said means to connect said connector means passing both therethrough and connecting to said hold down bar.

12. Improved means to interconnect as in claim 6 wherein said means to connect said connector means to said hold down bar is adapted to rigidly secure horizontal leg to the treadway.

13. Improved means to interconnect as in claim 1 wherein said attachment means partially received into said vertical member.

14. Improved means to interconnect as in claim 1 wherein said attachment means is vertically adjustable.

15. Improved means to interconnect as in claim 1 wherein said attachment means is secured to said vertical member by collar means.

16. Improved means to interconnect as in claim 15 wherein said collar means being carried by said vertical member.

17. Improved means to interconnect as in claim 1 wherein said vertical member being cylindrical.

18. Improved means to interconnect as in claim 1 wherein said attachment means comprising a lower portion secured to said vertical member, and a clamping post assembly.

19. Improved means to interconnect as in claim 18 wherein said clamping post assembly provided with at least one jaw means for engagement with the selected portion of the vehicle structure.

20. Improved means to interconnect as in claim 19 wherein said vehicle being provided with rocker panels and said jaw means being adapted for engagement therewith.

21. Improved means to interconnect as in claim 19 wherein said jaw means having a plurality of grasping jaw members with a bolt means passing therethrough to rigidly draw together said jaw members for engagement with the selected portion of the vehicle structure.

22. Improved means to interconnect as in claim 14 wherein said attachment means being vertically adjustable by a plurality of vertically aligned holes through a lower portion of said attachment means and a rod receivable within said holes and cooperable with said vertical member.

23. Improved means to interconnect as in claim 1 wherein said attachment means comprising a lower portion secured to said vertical member and post means engageable with a slot provided in the underside of the vehicle structure.

24. Improved means to interconnect as in claim 23 wherein said post means being elongated and having an upper finger portion which is adapted to rotate so as to securely engage with said slot.

25. Improved means to interconnect as in claim 24 wherein means being provided to secure said upper finger portion preventing rotation thereof.

26. Improved means to interconnect as in claim 25 wherein said means to secure said upper finger portion being a wedge received into an opening in said post means and in contact with said upper finger portion.

* * * * *